US006831400B2

(12) United States Patent
Takahashi et al.

(10) Patent No.: US 6,831,400 B2
(45) Date of Patent: Dec. 14, 2004

(54) COLOR CATHODE RAY TUBE APPARATUS HAVING AUXILIARY MAGNETIC FIELD GENERATOR

(75) Inventors: Tohru Takahashi, Osato-gun (JP); Masatsugu Inoue, Kumagaya (JP); Kumio Fukuda, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 22 days.

(21) Appl. No.: 10/012,571

(22) Filed: Dec. 12, 2001

(65) Prior Publication Data

US 2002/0079822 A1 Jun. 27, 2002

(30) Foreign Application Priority Data

Dec. 27, 2000 (JP) ..... 2000-398865

(51) Int. Cl.[7] ..... H01J 29/70

(52) U.S. Cl. ..... 313/440; 313/412; 313/413; 313/414; 313/442

(58) Field of Search ..... 313/409, 412, 313/413, 414, 446, 442, 440, 443, 415, 421

(56) References Cited

U.S. PATENT DOCUMENTS

| | | | | |
|---|---|---|---|---|
| 4,689,525 A | | 8/1987 | Shimoma et al. | 315/370 |
| 4,820,958 A | | 4/1989 | Shimoma et al. | 315/368 |
| 4,845,401 A | | 7/1989 | Shimoma et al. | 313/413 |
| 5,177,399 A | | 1/1993 | Fujiwara et al. | 313/440 |
| 5,206,559 A | * | 4/1993 | Fujiwara et al. | 313/440 |
| 5,225,736 A | * | 7/1993 | Fujiwara et al. | 313/440 |
| RE35,548 E | * | 7/1997 | Sluyterman et al. | 315/368.28 |
| 5,828,167 A | * | 10/1998 | Jitsukata et al. | 313/412 |
| 6,060,824 A | * | 5/2000 | Okamoto et al. | 313/431 |
| 6,380,667 B1 | * | 4/2002 | Yokota et al. | 313/440 |
| 6,388,402 B1 | * | 5/2002 | De Jong et al. | 315/368.28 |
| 6,518,697 B2 | * | 2/2003 | Wassink | 313/426 |

FOREIGN PATENT DOCUMENTS

| | | |
|---|---|---|
| JP | 51 85630 | 7/1976 |
| JP | 9265922 | 10/1997 |
| JP | 10112272 | 4/1998 |

* cited by examiner

*Primary Examiner*—Nimeshkumar D. Patel
*Assistant Examiner*—Kevin Quarterman

(57) ABSTRACT

An electron gun assembly of a color cathode ray tube emits at least one electron beam having an oblong cross-sectional shape extending substantially in the horizontal direction, and emits three electron beams in a substantially non-convergent state toward the central portion of a phosphor screen. A deflection device comprises an auxiliary magnetic field generator for generating a quadrupole magnetic field component which focuses the electron beam with an oblong cross section more heavily in the horizontal direction than in the vertical direction. The auxiliary magnetic field generator is located in a given region in a tube-axis direction in which the horizontally deflecting coil is located.

7 Claims, 6 Drawing Sheets

COLOR CATHODE RAY TUBE APPARATUS HAVING AUXILIARY MAGNETIC FIELD GENERATOR

CROSS-REFERENCE TO RELATED APPLICATIONS

This application is based upon and claims the benefit of priority from the prior Japanese Patent Application No. 2000-398865, filed Dec. 27, 2000, the entire contents of which are incorporated herein by reference.

BACKGROUND OF THE INVENTION

1. Field of the Invention

The present invention relates to color cathode ray tube apparatuses for TV sets, monitors, etc., and more particularly, to a color cathode ray tube apparatus capable of deflecting electron beams at wide angles.

2. Description of the Related Art

Color cathode ray tube apparatuses of the so-called self-convergence/in-line type are currently widely used. One such cathode ray tube apparatus comprises an in-line electron gun assembly, which emits three electron beams in a line, including a center beam and a pair of side beams that pass along one and the same horizontal plane. It further comprises a deflection device that generates a pincushion-type horizontally deflecting magnetic field and a barrel-type vertically deflecting magnetic field. This cathode ray tube apparatus, combining the electron gun assembly and the deflection device, converges the three electron beams on the whole area of a screen without requiring use of any special correcting circuit.

In general, in the color cathode ray tube apparatus of this type, the electron gun assembly emits the side beams at a given angle so as to converge the three electron beams at the center of the screen. The convergence of the three electron beams on the center of the screen is adjusted by means of a purity-convergence magnet (PCM) that is formed of a ring-shaped magnet on a neck portion of a color cathode ray tube.

Conventionally, there is a proposal to improve the convergence characteristics of the three electron beams by means of various types of correcting coils that are arranged in the deflection device. Described in Jpn. Pat. Appln. KOKAI Publication No. 9-265922, for example, is a correcting coil that is attached to the side of an electron gun assembly of a deflection yoke and generates a quadrupole magnetic field, whereby the convergence of the three electron beams can be corrected. Described in Jpn. Pat. Appln. KOKAI Publication No. 10-112272, moreover, is an auxiliary coil that is wound around a core of a deflection device for the same purpose. Described in Jpn. Pat. Appln. KOKAI Publication No. 51-85630, furthermore, is a barrel-type magnetic field, not pincushion-type, for dynamic convergence correction, which is used to correct deflection defocusing of electron beams.

The depth of a prevalent large-screen color cathode ray tube apparatus is increased in proportion to its screen size. If the screen size is enlarged with the maximum deflection angle of electron beams fixed, a reference point for deflection must be kept away from the screen in order to deflect the electron beams to the whole area of the large screen.

Recently, on the other hand, there has been an increasing demand for large-screen color cathode ray tube apparatuses with reduced depths. The depth of a large-screen cathode ray tube apparatus can be reduced most effectively by enlarging the deflection angle. However, the enlargement of the deflection angle considerably lowers the image quality in the peripheral portion of the screen or causes an increase in necessary dynamic focus voltage.

The lowering of the image quality in the peripheral portion of the screen occurs because deflection defocusing of electron beams which is horizontally extending beam distortion is accelerated as the deflection angle is enlarged. As described in the above, in order to converge the three electron beams also on the peripheral portion of the screen, the deflection device generates a non-uniform magnetic field that is formed of a barrel-type vertically deflecting magnetic field and a pincushion-type horizontally deflecting magnetic field. This non-uniform magnetic field also influences the shape of the electron beams. In particular, deflection defocusing that is caused by the horizontally deflecting magnetic field arouses a problem.

The influence of the horizontally deflecting magnetic field on the electron beams will now be described with reference to FIGS. 6A and 6B. In the description with reference to these drawings, the electron beams are supposed to be deflected to the right-hand side of the screen. As shown in FIG. 6A, the pincushion-type horizontally deflecting magnetic field, by virtue of its shape, generates a force that vertically depresses the electron beams and a force that laterally spreads the electron beams. These forces become stronger as the deflection angle widens or as the horizontally opposite end portions of the screen are approached.

In consequence, a beam spot has a horizontally elongated or oblong shape at each of the horizontally end portions of the screen, as shown in FIG. 6B. Even if a beam spot in the center of the screen is circular, therefore, beam spots at the horizontally end portions of the screen, obtained after the electron beams are horizontally deflected by the horizontally deflecting magnetic field, are oblong, so that the resolution of the image is lowered.

Further, the horizontally extending of the electron beams promotes a moiré effect in the peripheral portion of the screen. The wider the deflection angle, the higher the intensity of the horizontally deflecting magnetic field or pincushion-type magnetic field should be. Thus, the horizontally extending of the electron beams is enhanced with the enlargement of the deflection angle.

If the deflection angle is enlarged, the difference in the electron beam path length between the center and the peripheral portion of the screen increases. The increase in the path length difference causes vertical overfocusing of the electron beams by the horizontally deflecting magnetic field. Thus, the difference in the required proper magnification of the electron gun assembly between at the center and at the peripheral portion of the screen increases inevitably.

Accordingly, there is a great difference in dynamic focus voltage between the case where an electron beam is focused on the center of the screen and the case where the electron beam is focused on the peripheral portion of the screen. Thus, in order to maintain focusing characteristics for the peripheral portion of the screen without ruining focusing characteristics that are allowed for the center of the screen, the dynamic focus voltage must be increased in focusing the electron beams on the periphery of the screen. With use of an ordinary deflection angle (about 110°), the difference in dynamic focus voltage is adjusted to at most about 1 kV in order to focus the electron beams optimally on the center and the horizontally opposite end portions of the screen. If the deflection angle is wider (about 120°), on the other hand, the difference in dynamic focus voltage is several kilovolts.

The increase of the dynamic focus voltage constitutes a heavy load on the circuit of a TV set or monitor. If the dynamic focus voltage is too high, moreover, the color cathode ray tube apparatus itself arouses a problem on the withstand voltage. That is, the dynamic focus voltage, along with a dynamic component, its increment, is supplied from stem pins at the neck end portion. The stem pins are supplied with various voltages, such as cathode voltage, heater voltage, focusing voltage, etc., for controlling the color cathode ray tube apparatus. This is done because if the dynamic focus voltage is too high, there is a great voltage difference between the stem pins when a voltage is applied to the pins, so that the limit of the withstand voltage may possibly be exceeded.

In order to converge the three electron beams on the periphery of the screen, in general, moreover, the respective trajectories of the side beams are changed in the electron gun assembly by shifting central axes of the side beam holes between opposite electrodes that constitute a main lens portion, so that the side beams are emitted at a given angle from the electron gun assembly. If the difference in dynamic focus voltage is great, therefore, the side beams horizontally extended to so high a degree that the difference in shape between the center and side beams cannot be ignored.

Thus, in the color cathode ray tube apparatus of the wide-angle deflection type, the electron beams are horizontally extended by the non-uniform deflecting magnetic field of the deflection device, thereby lowering the resolution, and the dynamic focus voltage is increased to arouse a problem on the withstand voltage.

BRIEF SUMMARY OF THE INVENTION

The present invention has been contrived in consideration of these circumstances, and its object is to provide a color cathode ray tube apparatus capable of providing wide angles of deflection of electron beams and high resolution.

A color cathode ray tube apparatus according to an aspect of the present invention comprises: a cathode ray tube having an electron gun assembly which emits three electron beams arranged in a line and a phosphor screen which glows as the electron beams emitted from the electron gun assembly hit the phosphor screen; and a deflection device having a horizontally deflecting coil for generating a horizontally deflecting magnetic field which deflects the electron beams in a horizontal direction and a vertically deflecting coil for generating a vertically deflecting magnetic field which deflects the electron beams in a vertical direction, the electron gun assembly emitting at least one electron beam having an oblong cross-sectional shape extending substantially in the horizontal direction and emitting the three electron beams in a substantially non-convergent state toward the central portion of the phosphor screen, the deflection device including an auxiliary magnetic field generator for generating a quadrupole magnetic field component which focuses the electron beam with an oblong cross section more heavily in the horizontal direction than in the vertical direction, the auxiliary magnetic field generator being located in a given region in a tube-axis direction in which the horizontally deflecting coil is located.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A color cathode ray tube according to an embodiment of the present invention will now be described with reference to the accompanying drawings.

Figure 1:
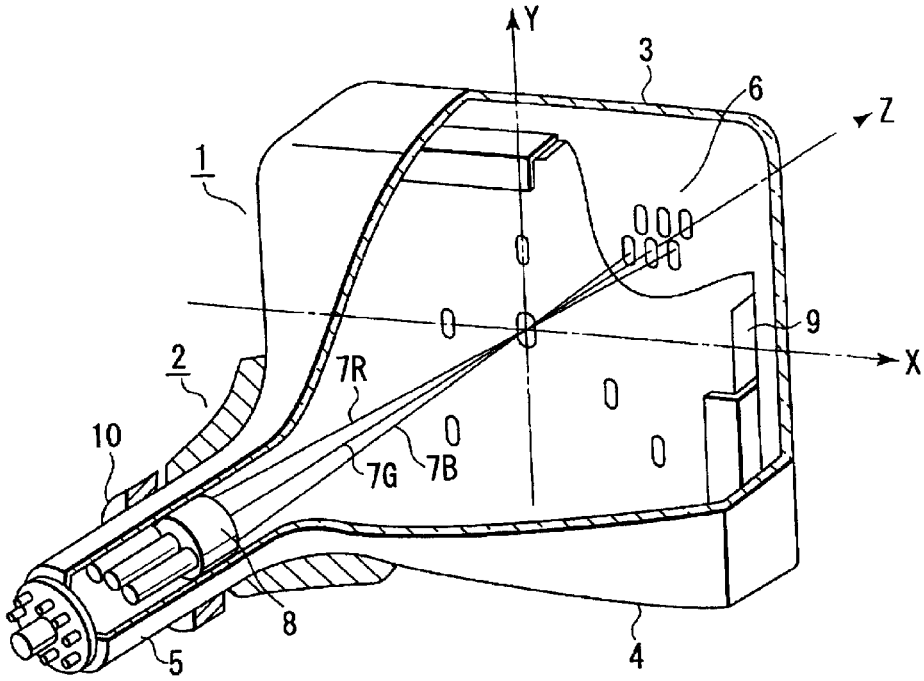
FIG. 1 schematically shows the construction of a color cathode ray tube apparatus according to an embodiment of the invention.

As shown in FIG. 1, the color cathode ray tube apparatus according to this embodiment comprises a color cathode ray tube 1 and a deflection device 2 attached to the outside of the tube 1. The color cathode ray tube 1 has an envelope that is composed of a substantially rectangular panel 3, a funnel 4 bonded to the periphery of the panel 3, and a neck 5 extending from the funnel 4.

The panel 3 is provided, on its inner surface, with a phosphor screen 6, which is formed of three-color phosphor layers that are arranged like dots or stripes and glow blue, green, and red. A shadow mask 9 for use as a color sorting electrode has a large number of electron beam holes and is opposed to the phosphor screen 6. The electron beam holes of the shadow mask 9 may be in any suitable shapes of dots or slots depending on the purpose of use.

An in-line electron gun assembly 8 is located in the neck 5. It emits three electron beams that are arranged in-line on a horizontal axis (X-axis), that is, a pair of side beams 7B and 7R that are arranged individually on the opposite side ends in the horizontal direction and a center beam 7G in the center.

Figure 10:
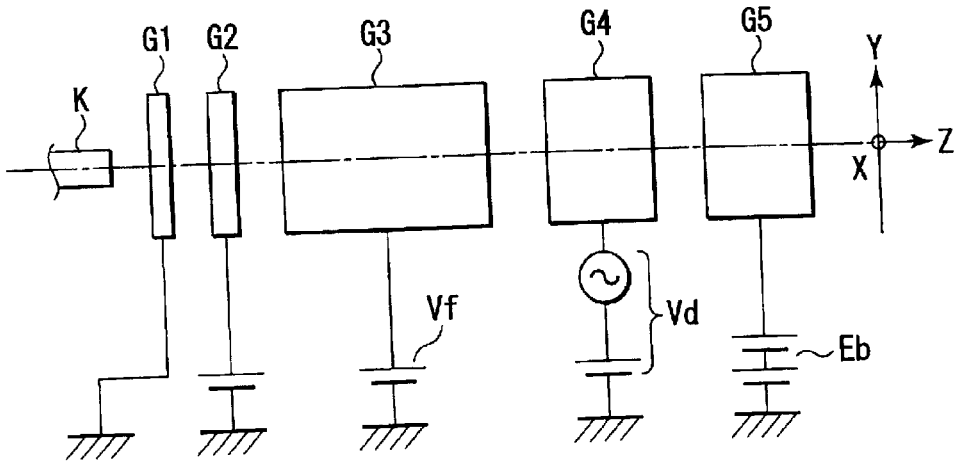
FIG. 10 schematically shows a configuration of an electron gun assembly applied to the color cathode ray tube apparatus shown in FIG. 1.

The electron gun assembly 8, which is of the dynamic-focus type, includes three cathodes K that are arranged in a line in a horizontal direction X, three heaters (not shown) for heating the cathodes K, individually, and five electrodes, as shown in FIG. 10. The five electrodes, which include a first grid G1, second grid G2, third grid G3 (focus electrode), fourth grid G4 (dynamic focus electrode), and fifth grid (anode), are arranged successively from the cathodes K toward the phosphor screen 6 in the direction of a tube axis Z. The heaters, cathodes K, and electrodes are supported integrally by means of a pair of insulating supporters. Each grid has three electron beam holes that are arranged in a line in the horizontal direction, corresponding to the three cathodes, individually.

In the electron gun assembly 8 constructed in this manner, a DC voltage of about 150 to 200 V on which a video signal is superposed is applied to the cathodes K. The first grid G1 is grounded. A DC voltage of, for example, about 600 to 1,000 V is applied to the second grid G2. A fixed voltage (focus voltage) Vf of about 6 to 10 kV, for example, is applied to the third grid G3. Applied to the fourth grid G4 is a dynamic focus voltage Vd that is obtained by superposing a dynamic component, which fluctuates in synchronism with the deflection of the electron beams, on a fixed voltage that is substantially equal to the focus voltage Vf. A fixed anode voltage of, for example, about 25 to 35 kV is applied to the fifth grid G5.

As the aforesaid voltages are applied individually to the grids, the electron gun assembly 8 forms an electron beam generating portion, prefocusing lens, and main lens. More specifically, the electron beam generating portion is formed of the cathodes K and the first and second grids G1 and G2. The electron beam generating portion generates an electron beam and forms an objective point for the main lens. The prefocusing lens is formed between the second and third grids G2 and G3. It prefocuses the electron beam emitted from the electron beam generating portion. The main lens is formed of the third, fourth, and fifth grids G3, G4 and G5. The main lens finally focuses the prefocused electron beam on the phosphor screen 6.

The electron gun assembly 8 emits the three electron beams 7B, 7G and 7R in a manner such that the cross section of each electron beam has a horizontally oblong shape. The electron beams having the oblong cross section can be formed by suitably setting the shape of the electron beam holes in the grids, voltages applied to the grids, lens effects of various electron lenses formed in the electron gun assembly 8, etc.

The electron gun assembly 8 emits the three electron beams toward the central portion of the phosphor screen 6 in a substantially non-convergent state. Preferably, in this embodiment, the non-convergent state should be adjusted so that the three electron beams are substantially parallel to one another. If the non-convergent state is such that the three electron beams are divergent, the electron beams may possibly run against the inner wall of the neck 5 in which the electron gun assembly 8 is located. Therefore, the non-convergent state of this divergent level is not very practical. If the electron beams only approach the inner wall of the neck without touching it, their trajectories are unstable. This implies that the convergence of the three electron beams is unstable. Thus, the electron gun assembly 8 of this embodiment emits three electron beams substantially parallel to one another in the direction of the tube axis Z.

The deflection device 2 is attached to an outer surface from a large-diameter portion of the funnel 4 to the neck 5. It generates a non-uniform deflecting magnetic field that deflects the three electron beams 7B, 7G and 7R from the electron gun assembly 8 in a horizontal direction (X) and a vertical direction (Y).

The three electron beams 7B, 7G and 7R emitted from the electron gun assembly 8 are deflected by means of the non-uniform magnetic field that is generated by the deflection device 2, and are used to scan the phosphor screen 6 in the horizontal and vertical directions through the shadow mask 9. Thus, a color image is displayed.

Further, the color cathode ray tube apparatus of this embodiment comprises a purity-convergence magnet (PCM) 10 that is formed of a ring-shaped magnet on the neck 5 of the color cathode ray tube 1. The PCM 10 serves to adjust the state of convergence of the three electron beams at the central portion of the picture plane.

Figure 2:
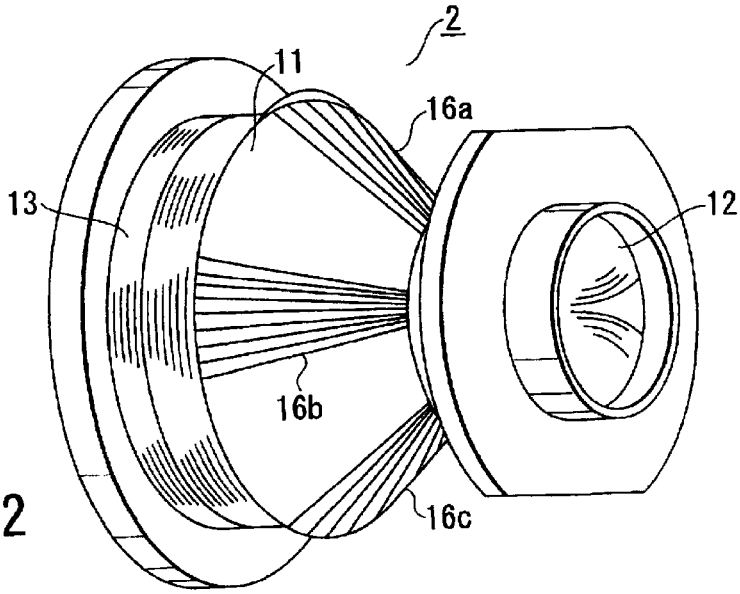
FIG. 2 schematically shows the construction of a deflection device applied to the color cathode ray tube apparatus shown in FIG. 1.

As shown in FIG. 2, the deflection device 2 comprises a conic and cylindrical magnetic core 11 having a large-diameter portion on the side of the phosphor screen 6 and a small-diameter portion on the side of the electron gun assembly 8. Further, the deflection device 2 comprises a saddle-type horizontally deflecting coil 12 and a saddle-type vertically deflecting coil 13, for use as main deflecting coils that are located inside of the magnetic core 11.

This deflection device 2 of the so-called saddle—saddle type generates a non-uniform magnetic field of a self-convergence type in which the three electron beams are deflected in the horizontal and vertical directions and converged. The non-uniform magnetic field is formed of a pincushion-type horizontally deflecting magnetic field 14 (indicated by broken line in FIG. 3) that is generated by means of the horizontally deflecting coil 12 and a barrel-type vertically deflecting magnetic field 15 (indicated by broken line in FIG. 4) that is generated by means of the vertically deflecting coil 13.

Figure 5:
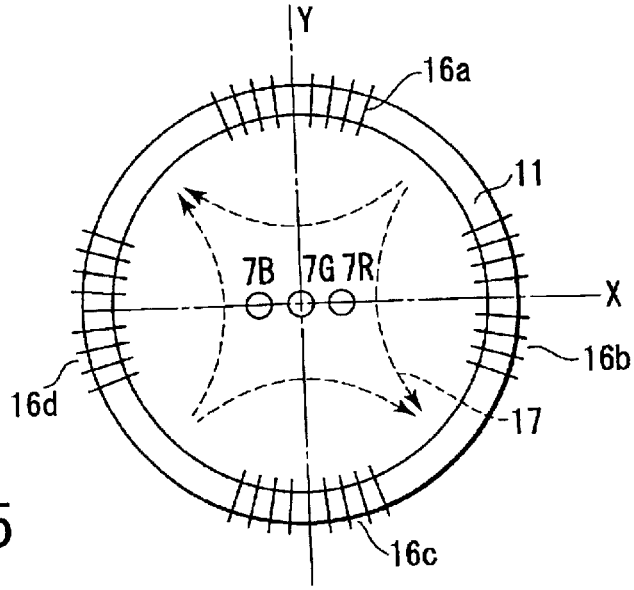
FIG. 5 is a diagram showing a quadrupole magnetic field component generated by means of an auxiliary magnetic field generator, as viewed from the panel side.

Furthermore, the deflection device 2 comprises four auxiliary magnetic field generating coils 16*a*, 16*b*, 16*c* and 16*d* that constitute an auxiliary magnetic field generator. In the embodiment shown in FIG. 2, the coils 16*a*, 16*b*, 16*c* and 16*d* are wound around the magnetic core 11. DC current is supplied to the coils 16*a* to 16*d*. Thus, the coils 16*a* to 16*d* generate a quadrupole magnetic field component 17, as shown in FIG. 5.

Figure 6A:
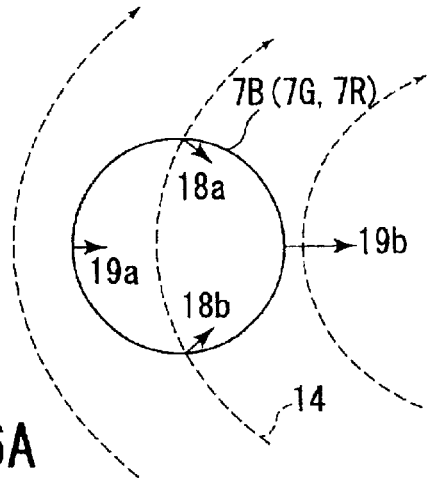
FIG. 6A is a diagram showing forces, as viewed from the panel side, an electron beam receives from the horizontally deflecting magnetic field.
Figure 6B:
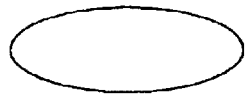
FIG. 6B is a diagram showing the shape of the electron beam transformed by means of the forces of FIG. 6A.

As described above, the deflection device 2 of this embodiment generates the quadrupole magnetic field component 17 besides the main deflecting magnetic fields 14 and 15. Out of these main deflecting magnetic fields, the pincushion-type horizontally deflecting magnetic field 14 generates a force that transforms the electron beams into horizontally elongated or oblong beams. If the electron beams are deflected to the right, as shown in FIG. 6A, by taking advantage of the shape of the horizontally deflecting magnetic field 14, forces 18*a* and 18*b* that vertically contract the electron beams 7B, 7G and 7R and forces 19*a* and 19*b* that horizontally expand the electron beams is generated. The electron beams that are subjected to these forces 18*a*, 18*b*, 19*a* and 19*b* form oblong beam spots, such as the one shown in FIG. 6B, on the horizontally opposite end portions of the picture plane.

Figure 7A:
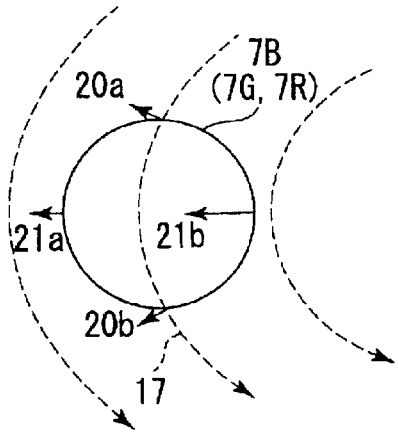
FIG. 7A is a diagram showing forces, as viewed from the panel side, the electron beam receives from the quadrupole magnetic field component.

On the other hand, the quadrupole magnetic field component 17 that is generated by means of the auxiliary magnetic field generating coils 16*a* to 16*d* of this embodiment generates a force that transforms the electron beams into vertically elongated or upright beams. If the electron beams are deflected to the right, as shown in FIG. 7A, by taking advantage of the shape of the magnetic field component 17, forces 20*a* and 20*b* that vertically expand the electron beams and forces 21*a* and 21*b* that horizontally contract the electron beams are generated. Thus, the magnetic field component 17 has a more intense focusing effect in the horizontal direction than in the vertical direction. In this embodiment, the quadrupole magnetic field component 17 has a focusing effect in the horizontal direction and a diverging effect in the vertical direction.

Figure 7B:
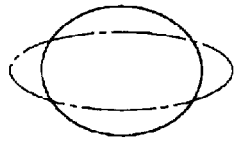
FIG. 7B is a diagram showing the shape of the electron beam subjected to the forces from both the horizontally deflecting magnetic field and the quadrupole magnetic field component.

In consequence, the shape of the beam spots formed on the horizontally end portions of the screen can be improved by means of the respective effects of the pincushion-type horizontally deflecting magnetic field 14 and the quadrupole magnetic field component 17 of the auxiliary magnetic field generating coils 16*a* to 16*d*. Thus, the shape of each beam spot on each of the horizontally end portions of the screen can be made more upright or less oblong than the conventional one (indicated by broken line in FIG. 7B), as indicated by solid line in FIG. 7B.

Figure 3:
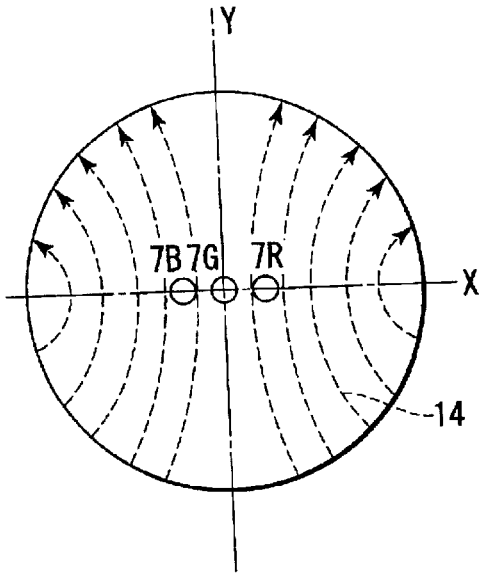
FIG. 3 is a diagram showing a horizontally deflecting magnetic field as viewed from the panel side.
Figure 4:
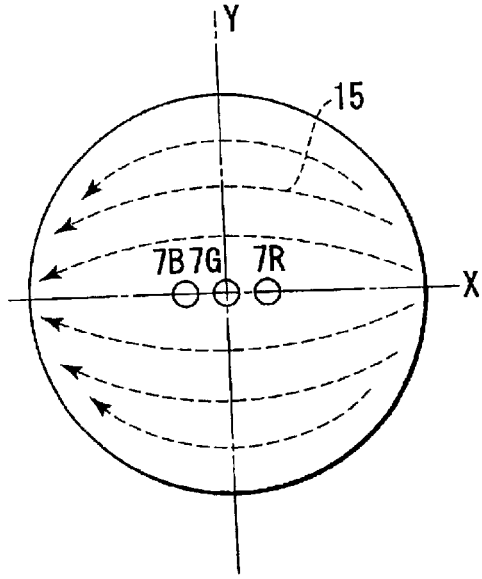
FIG. 4 is a diagram showing a vertically deflecting magnetic field as viewed from the panel side.

Although the electron beams are deflected to the right in this case, the same result can be also obtained in the case where the electron beams are deflected to the left-hand side of the screen. In the case where the electron beams are deflected to the left-hand side of the screen, the arrows that indicate the respective directions of the magnetic fields shown in FIGS. 3 and 4 are redirected oppositely. The forces that the electron beams deflected to the left receive are able to be shown by rotating FIGS. 6A and 7A, 180°. As in the case where the electron beams are deflected to the right, therefore, the magnetic field component 17 acts reversely to the pincushion-type horizontally deflecting magnetic field 14, so that the degree of oblongness of the beam spot shape can be lowered.

These conditions indicate a state such that the magnetic fields of FIGS. 6A and 7A are synthesized to form a nearly uniform magnetic field. Since the deflecting magnetic field is nearly uniform, vertical overfocusing that used to occur in a conventional pincushion-type horizontally deflecting magnetic field can be weakened. Accordingly, the dynamic focus voltage that used be applied to the conventional electron gun assembly in order to correct the overfocusing can be lowered considerably. Thus, problems on the withstand voltage can be eliminated.

The auxiliary magnetic field generating coils 16*a* to 16*d* that generate the quadrupole magnetic field component 17, in the deflection device 2, are located so that they are superposed on the horizontally deflecting coil 12 within a given region of a length in the tube-axis direction in which the coil 12 is located. This is done because a satisfactory correction effect cannot be obtained for the distortion of the aforesaid beam spots even if the coils 16*a* to 16*d* are located nearer to the electron gun assembly 8 than the coil 12 is.

That is, if the auxiliary magnetic field generating coils 16*a* to 16*d* are located nearer to the electron gun assembly 8 than the main deflecting coils 12 and 13 of the deflection device 2 are, the electron beams pass through the horizontally deflecting magnetic field 14 after they pass through the quadrupole magnetic field component 17. Since the magnetic field component 17 generates a force to transform the electron beams into vertically elongated beams, the electron beams that have a vertically elongated cross section pass through the magnetic field 14.

The horizontally deflecting magnetic field 14 is distributed having a certain length in the tube-axis direction Z. If electron beams having a vertically elongated cross section are incident upon the deflecting magnetic field, therefore, the magnetic field 14 subjects them to a force that causes them to be transformed into more oblong beams than conventional ones. The resulting beam spots are deformed more oblongly than conventional ones. Since the vertical diameter of the electron beams incident upon the deflecting magnetic field is enlarged, moreover, the vertical astigmatism of the deflecting magnetic field inevitably has a great influence.

Figure 13A:
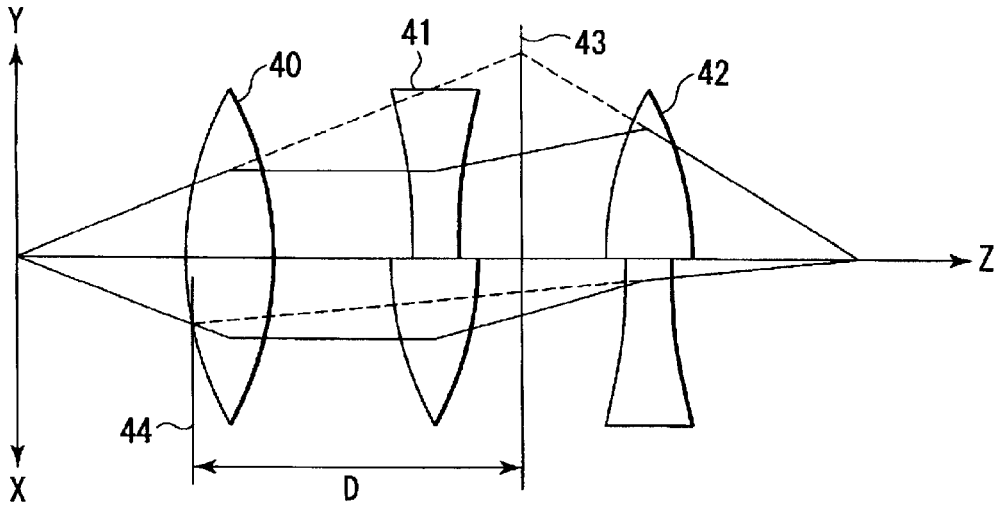
FIGS. 13A and 13B are equivalent optical lens model diagrams for illustrating the relationships between the respective positions of a main lens of the electron gun assembly, auxiliary magnetic field generator, and deflection device and the position of a principal lens surface.
Figure 13B:
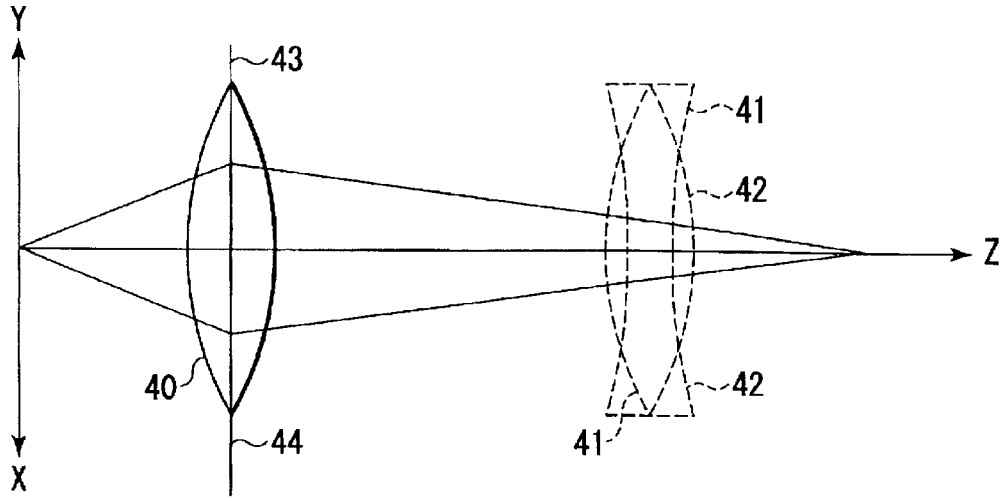

This phenomenon will now be described in detail with reference to FIGS. 13A and 13B. FIGS. 13A and 13B show the main lens 40 of an electron gun assembly, the quadrupole magnetic field component 41 of the deflection device, and the deflecting magnetic field 42. These are considered to greatly influence the beam spot shape. The magnetic field component 41 is shown as an equivalent lens that has a diverging effect in the vertical direction and a focusing effect in the horizontal direction. The magnetic field 42 is shown as an equivalent lens that has focusing effects in the vertical direction and a diverging effect in the horizontal direction.

In the case where the auxiliary magnetic field generating coils are located on the electron-gun-assembly side of the deflection device, the quadrupole magnetic field component 41 is situated nearer to the electron gun assembly than the deflecting magnetic field 42, as shown in FIG. 13A. In this case, a principal lens surface 43 in the vertical direction is situated nearer to the phosphor screen than a principal lens surface 44 in the horizontal direction is. Accordingly, there is a difference in magnification between the horizontal and vertical directions. More specifically, the magnification in the horizontal direction is higher than that in the vertical direction. In consequence, a beam spot on the phosphor screen has an oblong shape with a small vertical diameter and a large horizontal diameter. In this lens configuration, a difference D in position between the principal lens surfaces 43 and 44 cannot be eliminated.

In the case where the auxiliary magnetic field generating coils are located in the deflection device, on the other hand, the quadrupole magnetic field component 41 is situated in the deflecting magnetic field 42, as shown in FIG. 13B. If the magnetic field component 41 and the magnetic field 42 entirely cancel each other out, in this arrangement, the principal lens surface 43 in the vertical direction and the principal lens surface 44 in the horizontal direction are entirely coincident with each other. In this case, the magnifications in the horizontal and vertical directions are identical. In consequence, the beam spot on the phosphor screen has the shape of a perfect circle. Actually, the quadrupole magnetic field component 41 and the deflecting magnetic field 42 cannot entirely cancel each other, as shown in FIG. 13B. However, the influence of the magnetic field 42 can be reduced securely.

As the auxiliary magnetic field generating coils 16*a* to 16*d* are located within the given region in the tube-axis direction in which the horizontally deflecting coil 12 is located, therefore, the quadrupole magnetic field component 17 can be caused to act so as to restrain the electron beams from being horizontally extended by the pincushion-type horizontally deflecting magnetic field 14.

When the deflection device 2 including the auxiliary magnetic field generating coils 16*a* to 16*d* is not actuated, in this embodiment, moreover, the electron beams 7B, 7G and 7R having an oblong cross section are made to pass thought the magnetic field of the deflection device 2 and are then focused on the central portion of the picture plane. Preferably, this cross-sectional shape should be controlled according to the shape of the electron beam holes in the grids of the electron gun assembly 8, as mentioned before. Since the electron beams are not influenced by the deflecting magnetic field, the shape of the beam spots on the central portion of the screen can be easily adjusted according to the design of the grids.

The electron gun assembly 8 emits the electron beams with the horizontally oblong cross section in order to make the beam spots at the central portion of the screen circular. DC current is supplied to the auxiliary magnetic field generating coils 16*a* to 16*d* for the reason mentioned later. Even in the case where the electron beams are focused on the central portion of the screen, therefore, they are subjected to a force from the quadrupole magnetic field component 17 that transform them into vertically elongated beams. If the electron beams emitted from the electron gun assembly 8 have the horizontally oblong cross section in this case, the beam spots on the central portion of the screen can be made circular. Since the electron beams have the oblong cross section, moreover, their vertical diameter can be reduced. Thus, the influence of components of force that cause the electron beams to be horizontally extended due to the horizontal deflecting magnetic field that vertically act on the electron beams, can be lessened. In consequence, the horizontally extending of the beam spots can be lessened even in the case where the electron beams are deflected in the horizontal direction.

Figure 8:
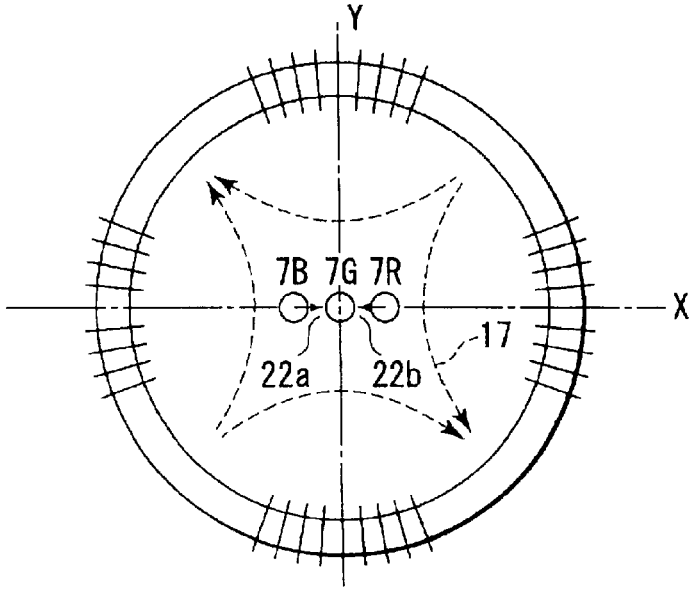
FIG. 8 is a diagram showing a state viewed from the panel side and illustrating the convergence of three electron beams by means of the quadrupole magnetic field component generated by the auxiliary magnetic field generator.
Figure 9:
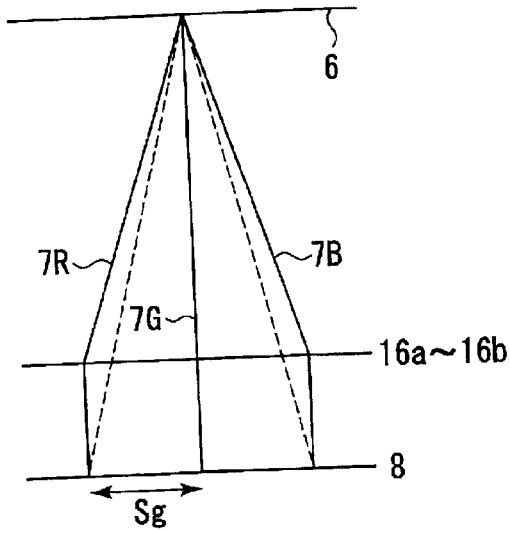
FIG. 9 is a diagram typically illustrating the respective trajectories of the three electron beams.

Further, the auxiliary magnetic field generating coils 16*a* to 16*d* generate magnetic field components that converge the three electron beams. As shown in FIG. 8, the quadrupole magnetic field component 17 acts on the three electron beams 7B, 7G and 7R in common. Therefore, magnetic field component 17 generates forces 22*a* and 22*b* in directions such that the space between the side beams 7B and 7R is reduced. Thus, the magnetic field component 17 has an effect to converge the three electron beams. In this embodiment, as mentioned before, therefore, the electron gun assembly 8 can emit the three electron beams 7B, 7G and 7R substantially parallel to one another. FIG. 9 shows this state.

FIG. 9 is a diagram schematically showing the respective trajectories of the three electron beams that reach the central portion of the screen. In FIG. 9, solid lines represent beam trajectories according to this embodiment, while broken lines represent conventional beam trajectories. In the conventional case, the three electron beams 7B, 7G and 7R are emitted from the electron gun assembly 8 at predetermined angles such that they are converged on the central portion of the screen. In the case of the color cathode ray tube apparatus according to this embodiment, on the other hand, the three electron beams 7B, 7G and 7R from the electron gun assembly 8 are emitted substantially parallel to one another. The parallel side beams 7B and 7R are deflected to be converged by means of the quadrupole magnetic field component that is generated by means of auxiliary magnetic field generating coils 16*a* to 16*d* in the deflection device 2.

DC current, not dynamic current, is supplied to the auxiliary magnetic field generating coils 16*a* to 16*d*. In the case where the electron beams are deflected toward the periphery in the horizontal (X-axis) direction, the intensity of the quadrupole magnetic field component 17 should be increased in order to improve the distortion of the beam spots. In order to converge the three electron beams, however, it is advisable to lower the intensity of the quadrupole magnetic field component. Thus, the beam spot distortion and the convergence reversely require the intensity from the quadrupole magnetic field component 17. It is practically insignificant, therefore, to drive one coil dynamically. Accordingly, it is effective to supply DC current to the auxiliary magnetic field generating coils 16*a* to 16*d*.

According to the color cathode ray tube apparatus of this embodiment, as described above, the quadrupole magnetic field component situated in the deflecting magnetic field, which applies the force to the electron beams to transform them forward vertically elongated beams, can restrain the beam spot shape from becoming horizontally oblong. Thus, the resolution can be improved.

If the deflection angle of an electron beam is widened, moreover, the quadrupole magnetic field component that is generated by means of the auxiliary magnetic field generating coils can restrain the electron beam from being vertically overfocused by means of the horizontally deflecting magnetic field. Thus, it is possible to restrain the difference in dynamic focus voltage between the case where the electron beam reaches the central portion of the screen and the case where the electron beam reaches the peripheral portion of the screen, that is, an increase of dynamic components that are superposed on the fixed voltage. Even in a color cathode ray tube apparatus of the wide-angle deflection type, therefore, dynamic voltages that are practical enough can be employed. In consequence, no excessive load can be applied to the circuits of TV sets or monitors, and problems on the withstand voltage, such as sparks between stem pins, can be restrained from being aroused.

Further, the auxiliary magnetic field generating coils 16*a* to 16*d* can converge the three electron beams on the central portion of the screen. Accordingly, the electron gun assembly 8 can emit the side beams 7B and 7R substantially parallel to one another. Thus, deterioration of the side beam shape, which is conventionally caused when the respective trajectories of the side beams 7B and 7R are changed in the electron gun assembly, can be restrained.

It is to be understood that the present invention is not limited to the embodiment described above, and that various changes and modifications may be effected therein by one skilled in the art without departing from the scope or spirit of the invention.

In the embodiment described above, for example, the auxiliary magnetic field generator that generates the quadrupole magnetic field component is composed of the auxiliary magnetic field generating coils 16*a* to 16*d* that are wound on the magnetic core 11 of the deflection device 2. Alternatively, however, the quadrupole magnetic field component can be generated by means of a simple coil that is not wound around the magnetic core 11.

Figure 11:
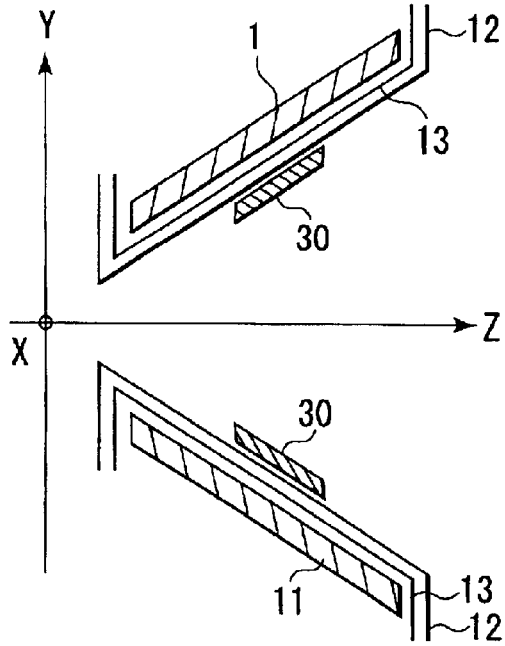
FIG. 11 schematically shows a vertical profile of a deflection device applied to a color cathode ray tube apparatus according to another embodiment of the invention.
Figure 12:
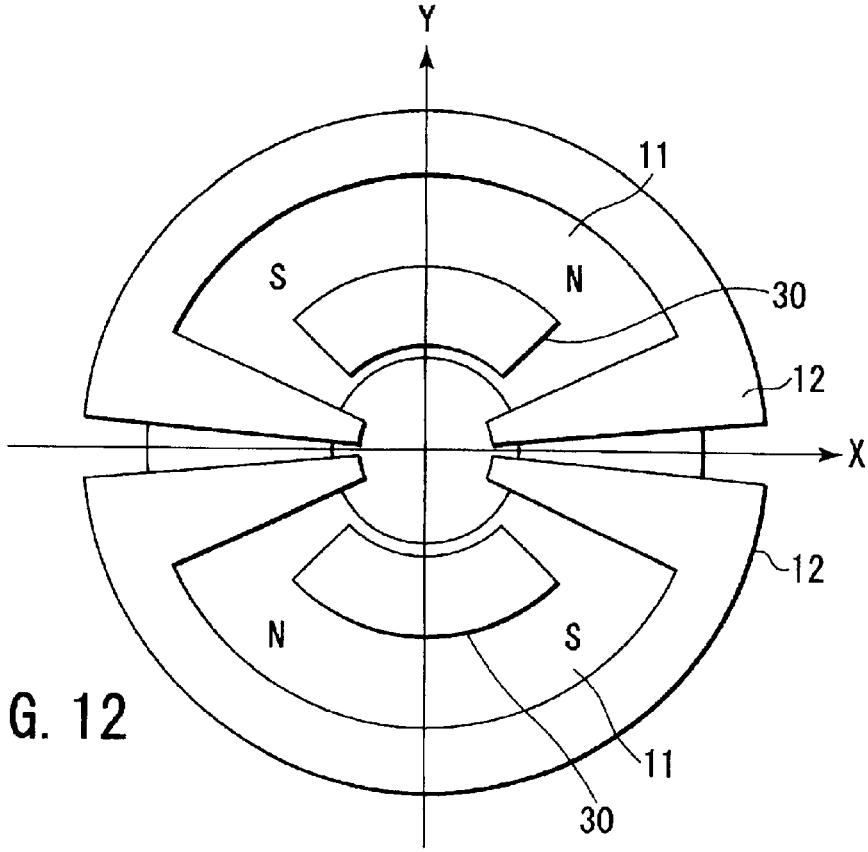
FIG. 12 schematically shows the construction of the deflection device of FIG. 11, as viewed from panel side.

As shown in FIGS. 11 and 12, moreover, the quadrupole magnetic field component may be generated by means of permanent magnets 30 located in the deflection device 2 without using any coils. In this case, as in the case where the coils are used, the permanent magnets 30 are arranged so as to be superposed on the horizontally deflecting coil 12 within a given region in the tube-axis direction Z in which the coil 12 is located. This embodiment can produce the same effects as mentioned previously.

In the foregoing embodiment, furthermore, the three electron beams 7B, 7G and 7R emitted from the electron gun assembly 8 run substantially parallel to one another. If the space between the two side beams 7B and 7R in the electron gun assembly 8 is adjusted to 2·Sg, as shown in FIG. 9, however, the beam range in the center of the screen is greater than Sg and smaller than 3·Sg. Within this range, the convergence can be adjusted by means of the quadrupole magnetic field component without lowering the effects.

Further, the deflection device of the present invention is not limited to the saddle-saddle type, and may be of the semi-toroidal type. Furthermore, the deflection device may be formed having a plurality of magnetic cores in place of one.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube apparatus comprising:

a cathode ray tube having an electron gun assembly which emits three electron beams arranged in a line and a phosphor screen which glows as the electron beams emitted from the electron gun assembly hit the phosphor screen; and a deflection device having a horizontally deflecting coil for generating a horizontally deflecting magnetic field which deflects the electron beams in a horizontal direction and a vertically deflecting coil for generating a vertically deflecting magnetic field which deflects the electron beams in a vertical direction, the electron gun assembly emitting at least one electron beam having an oblong cross-sectional shape extending substantially in the horizontal direction and emitting the three electron beams in a substantially non-convergent state toward the central portion of the phosphor screen, the deflection device including an auxiliary magnetic field generator for generating a quadrupole magnetic field component which focuses the electron beam with an oblong cross section more heavily in the horizontal direction than in the vertical direction, and the auxiliary magnetic field generator being located in a given region in a tube-axis direction in which the horizontally deflecting coil is located.

2. A color cathode ray tube apparatus according to claim 1, wherein said auxiliary magnetic field generator includes coils supplied with DC current.

3. A color cathode ray tube apparatus according to claim 1, wherein said deflection device includes a cylindrical magnetic core having a small-diameter portion located on the side of the electron gun assembly and a large-diameter portion located on the side of the phosphor screen, and said auxiliary magnetic field generator comprises coils wound around the magnetic core.

4. A color cathode ray tube apparatus according to claim 1, wherein said electron gun assembly is of the dynamic-focus type.

5. A color cathode ray tube apparatus according to claim 1, wherein said auxiliary magnetic field generator generates a magnetic field component for converging the three electron beams.

6. A color cathode ray tube apparatus according to claim 1, wherein said horizontally deflecting coil of said deflection device generates a pincushion-type deflecting magnetic field, and said vertically deflecting coil generates a barrel-type deflecting magnetic field.

7. A color cathode ray tube apparatus according to claim 1, wherein said electron gun assembly emits the three electron beams substantially parallel to one another.

* * * * *